US012085080B2

(12) United States Patent
Wang et al.

(10) Patent No.: US 12,085,080 B2
(45) Date of Patent: Sep. 10, 2024

(54) WATER PUMP WITH SUSPENSION FUNCTION

(71) Applicant: GP ENTERPRISES CO., LTD., Jiangsu (CN)

(72) Inventors: Xian Wang, Jiangsu (CN); Ningning Ding, Jiangsu (CN)

(73) Assignee: GP ENTERPRISES CO., LTD., Suzhou (CN)

( * ) Notice: Subject to any disclaimer, the term of this patent is extended or adjusted under 35 U.S.C. 154(b) by 0 days.

(21) Appl. No.: 18/370,400

(22) Filed: Sep. 20, 2023

(65) Prior Publication Data

US 2024/0003349 A1 Jan. 4, 2024

Related U.S. Application Data

(63) Continuation of application No. PCT/CN2022/093427, filed on May 18, 2022.

(30) Foreign Application Priority Data

May 9, 2022 (CN) ..... 202210496377.5
May 9, 2022 (CN) ..... 202221088634.3

(51) Int. Cl.

| | |
|---|---|
| ***F04D 13/06*** | (2006.01) |
| ***F04D 29/00*** | (2006.01) |
| ***F04D 29/08*** | (2006.01) |
| ***F04D 29/42*** | (2006.01) |

(52) U.S. Cl.

CPC ..... *F04D 13/066* (2013.01); *F04D 13/0693* (2013.01); *F04D 29/005* (2013.01); *F04D 29/086* (2013.01); *F04D 29/426* (2013.01)

(58) Field of Classification Search

CPC .... F04D 13/066; F04D 13/0653; F04D 13/08; F04D 29/00; F04D 29/005; F04D 29/086; F04D 29/42; F04D 29/426

See application file for complete search history.

(56) References Cited

U.S. PATENT DOCUMENTS 3,153,382 A * 10/1964 Van Blarcom, Jr. ..... F04D 13/086 310/90
5,074,764 A 12/1991 Kobayashi et al.
5,336,064 A * 8/1994 Lamers ..... F04D 13/083 417/423.3
11,835,061 B1 * 12/2023 Patton ..... F04D 7/04

FOREIGN PATENT DOCUMENTS

CN 2191303 Y 3/1995
CN 110454431 A 11/2019

OTHER PUBLICATIONS

Machine translation of CN2191303Y, retrieved from ESPACENET on Jan. 27, 2024 (Year: 2024).*

* cited by examiner

*Primary Examiner* — Sang K Kim

(57) ABSTRACT

This application discloses a water pump with a suspension function, including: a pump casing, a pump cover, a motor, a pressing ring, a volute and a base. In this way, the water pump with the suspension function disclosed in this application has an upper part suspended on a water surface to clarify the position of the water pump, thus preventing the problem of being buried by underwater mud and sucking in underwater impurities, and protecting a sealing structure at the upper part of the pump casing.

8 Claims, 5 Drawing Sheets

WATER PUMP WITH SUSPENSION FUNCTION

CROSS REFERENCE TO RELATED APPLICATIONS

The present application is a Continuation Application of PCT Application No. PCT/CN2022/093427 filed on May 18, 2022, which claims the benefit of Chinese Patent Application Nos. 202210496377.5 and 202221088634.3 filed on May 9, 2022. All the above are hereby incorporated by reference in their entirety.

TECHNICAL FIELD

This application relates to the field of water pumps, in particular to a water pump with a suspension function.

BACKGROUND

When using the existing water pump, it is either used in water or on the ground. The water pump used in the water is prone to being buried by mud at the bottom, and sucking in underwater impurities or being blocked by underwater impurities. There is also a problem of damage to the motor due to water ingress.

The water pump used on the ground is prone to overheating after long-term operation, and has poor adaptability to water surface height. There is also a problem of leakage in an inlet pipe, which needs to be improved.

SUMMARY

The technical problem to be mainly solved by this application is to provide a water pump with a suspension function, which can be suspended on a water surface for use and improve the stability of suspension and working.

In order to solve the technical problem, this application adopts the following technical solution: a water pump with a suspension function, comprising: a pump casing 1, a pump cover 5, a motor 7, a pressing ring 4, a volute 8 and a base 12, a top of an inner cavity of the pump casing 1 being provided with a motor mounting chamber 108 extending downwards and a closed chamber 109 located around the motor mounting chamber 108, the motor 7 being vertically provided in the motor mounting chamber 108 and extending downwards to a position below the motor mounting chamber 108, the pressing ring 4 being provided on a housing of the motor 7 in a sleeving manner and being located at a bottom of the motor mounting chamber 108, a top of the pump casing 1 being provided with a water outlet pipe joint 101 extending downwards, a first connecting port 107 communicated with the water outlet pipe joint 101 and extending downwards being provided in an inner wall of the pump casing 1, the pump cover 5 being provided below the first connecting port 107 and the motor 7, a plurality of supporting columns 501 pointing to the pressing ring 4 being provided on the pump cover 5, a plurality of connecting rod screw holders 503 downwards pointing to the pump cover 5 being provided in the pump casing 1, connecting rod screws 6 connected to the connecting rod screw holders 503 being provided on the pump cover 5, a second connecting port 502 in insertion connection with the first connecting port 107 being provided in the pump cover 5, the volute 8 being provided at a bottom of the pump cover 5, screws 11 connected to the pump cover 5 being provided on the volute 8, a motor rotating shaft 10 extending downwards into the volute 8 being provided in the motor 7, a bottom of the motor rotating shaft 10 being provided with an impeller 9 located in the volute 8, the base 12 being provided below the volute 8, a surrounding area of the base 12 being in contact with a bottom of the inner wall of the pump casing 1 for closing, connecting fasteners 106 downwards running through the base 12 being provided in the pump casing 1, a plurality of filter screen holes 1203 being provided in the base 12.

In an exemplary embodiment of this application, the pump casing 1 adopts a biomimetic turtle shell structure.

In an exemplary embodiment of this application, a turtle shell pattern 104 is provided on an outer wall of the pump casing 1, and an edge of the pump casing 1 is provided with a turtle-shell-shaped corrugated skirt 105.

In an exemplary embodiment of this application, a first sealing ring 13 is provided between the first connecting port 107 and the second connecting port 502.

In an exemplary embodiment of this application, a second sealing ring 14 located above the pressing ring 4 is provided between the housing of the motor 7 and an inner wall of the motor mounting chamber 108.

In an exemplary embodiment of this application, a top of the pump cover 5 is provided with a valve 102 extending into the motor mounting chamber 108.

In an exemplary embodiment of this application, fastener slots 1201 corresponding to the connecting fasteners 106 are provided in the base 12.

In an exemplary embodiment of this application, a bottom of the base 12 is provided with a plurality of feet 1202.

In an exemplary embodiment of this application, a bottom of the volute 8 is provided with a water inlet 801 located below the impeller 9.

In an exemplary embodiment of this application, the water pump with the suspension function further comprises a cable 3, a cable interface 103 is provided in the pump casing 1, a front end of the cable 3 extends to the cable interface 103 for insertion connection, and a lifting handle 2 in threaded connection with the cable interface 103 is provided on the cable 3 in a sleeving manner.

This application has the following beneficial effects: in the water pump with the suspension function disclosed in this application, the pump casing 1 is specially designed, the positioning of the motor 7 and the increase of buoyancy are achieved through the motor mounting chamber 108, and the buoyancy and suspension stability on the water surface are ensured through the closed chamber 109, so that the lower part of the housing of the motor 7 can be immersed in water for water cooling to improve working stability; through the rotation of the impeller 9, the water flow is sent to the second connecting port 502, and finally, the water is sent out through the water outlet pipe joint 101. The pump casing 1 may adopt a biomimetic structure, which is attractive and aesthetic. When used, the lower part of the water pump is under water, and the upper part is suspended on the water surface. When used in landscape, artificial waterfall or fountain environments, the position of the water pump can be clearly known on the water surface, and it has good adaptability to changes in water surface height, thus avoiding the problem of being buried by underwater mud and sucking in underwater impurities, protecting the sealing structure on the upper part of the pump casing, and helping to prolong the service life of the water pump.

BRIEF DESCRIPTION OF THE DRAWINGS

In order to describe the technical solution in the embodiments of this application more clearly, the drawings required in the description of the embodiments will be briefly described. Apparently, the drawings in the following description are only some embodiments of this application. Those skilled in the art may obtain other drawings based on these drawings without contributing any inventive labor.

DETAILED DESCRIPTION OF THE EMBODIMENTS

The technical solutions in the embodiments of this application will be described below clearly and completely. Obviously, the described embodiments are only a part of the embodiments of this application, not all of them. Based on the embodiments of this application, all other embodiments obtained by those skilled in the art without contributing any inventive labor also fall within the scope of protection of this application.

Figure 1:
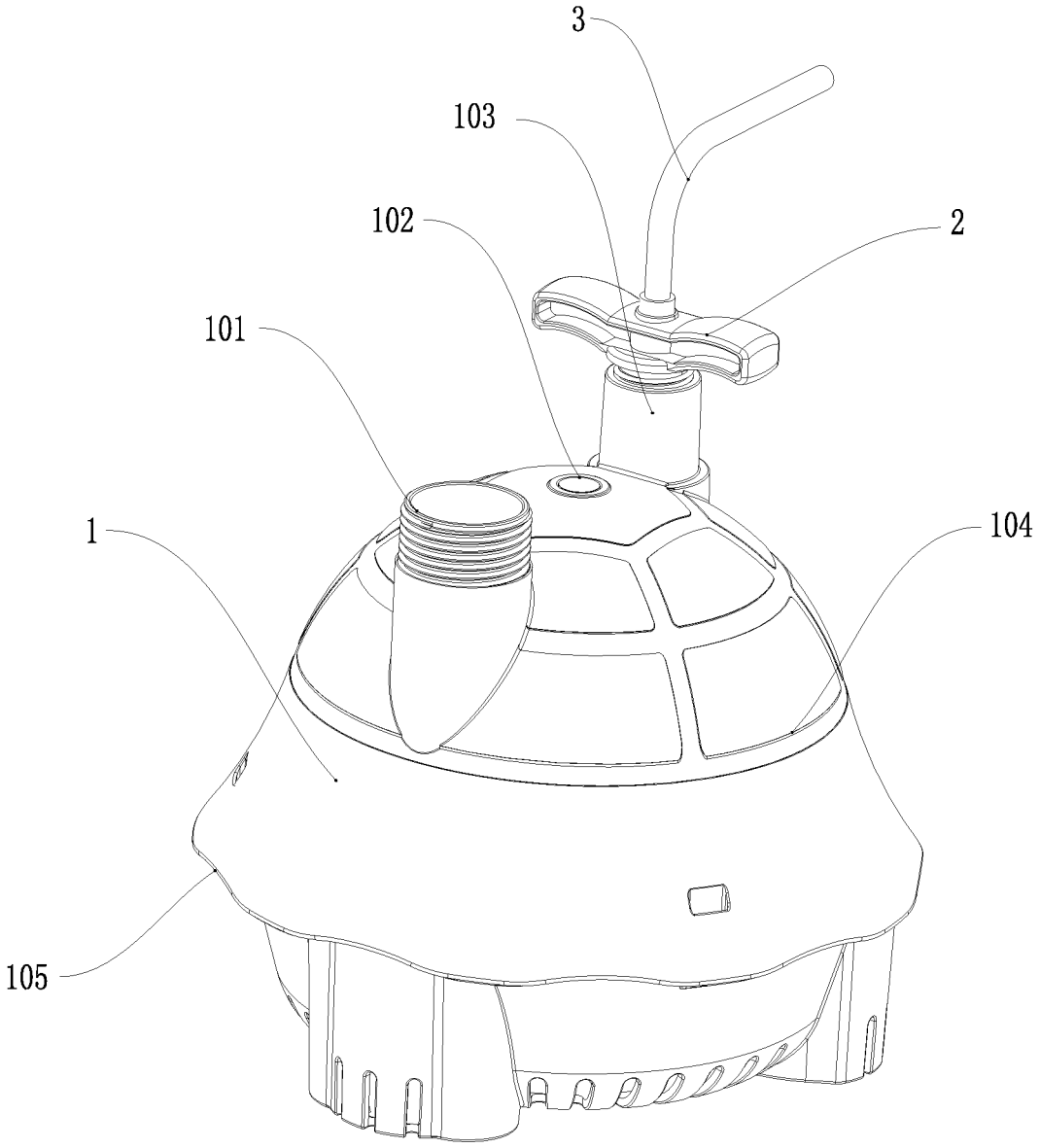
FIG. 1 illustrates a structural schematic diagram of a water pump with a suspension function according to an exemplary embodiment of this application.
Figure 2:
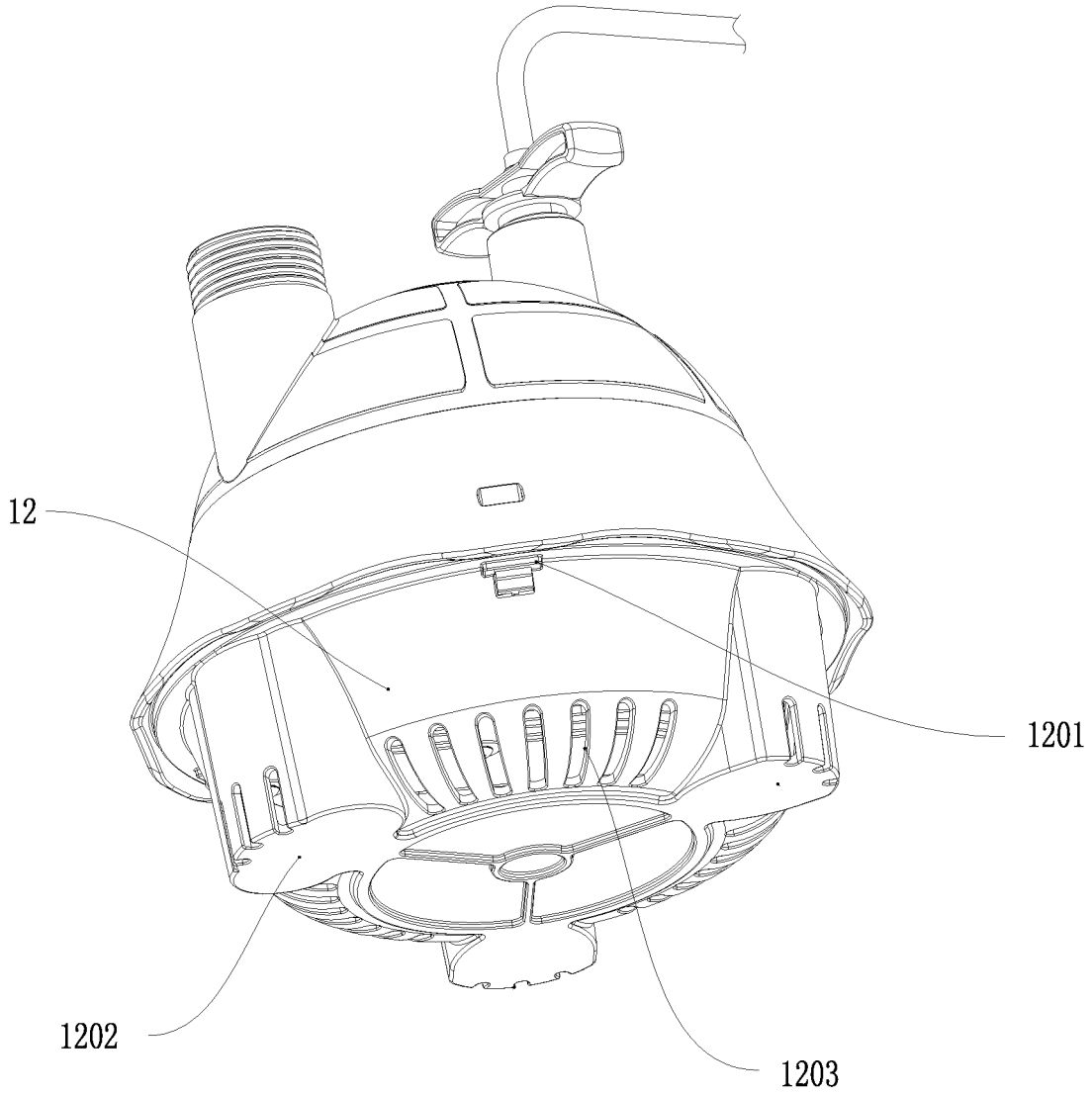
FIG. 2 illustrates a view of FIG. 1 from another angle.
Figure 3:
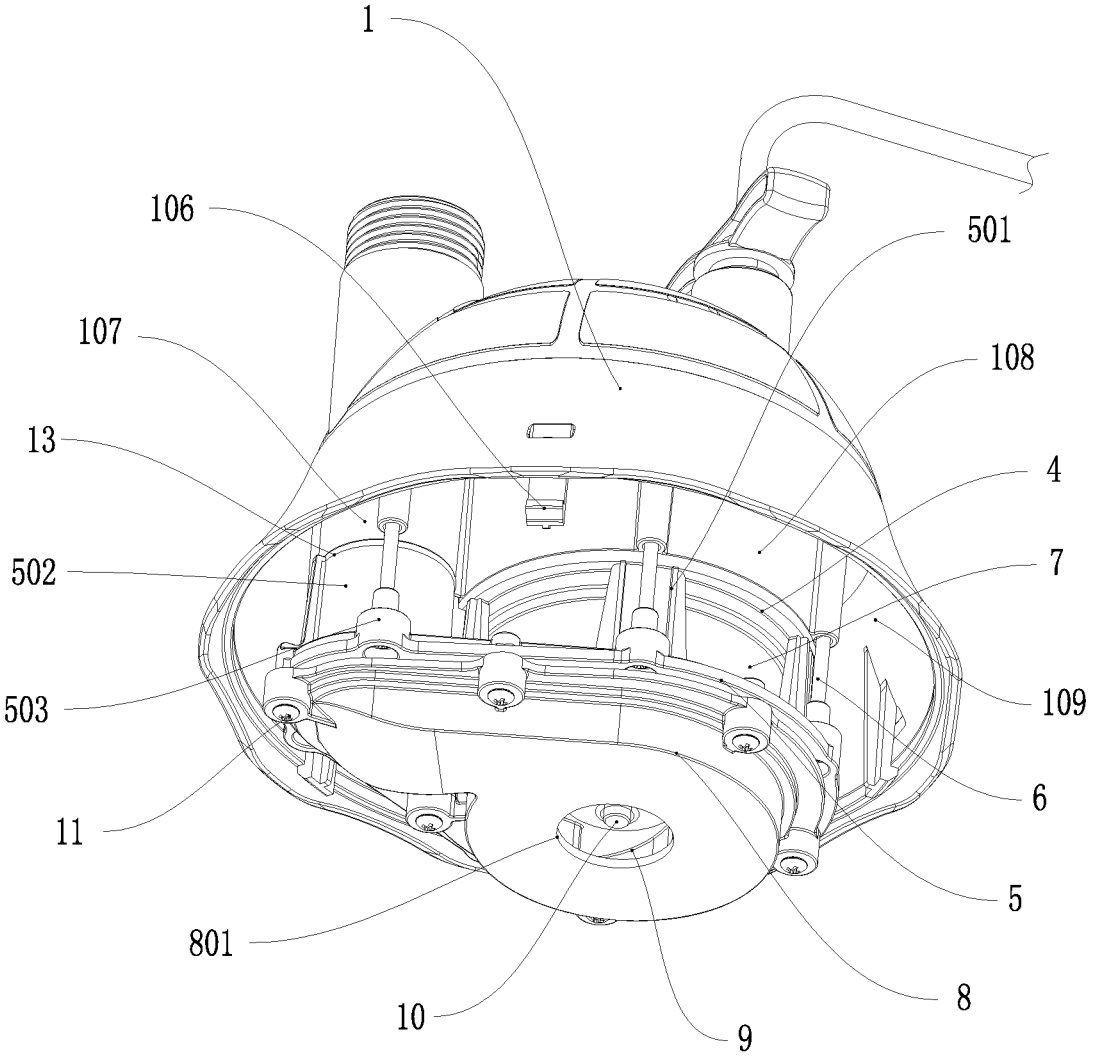
FIG. 3 illustrates a structural schematic diagram of a water pump with a suspension function in FIG. 2 after a base 12 is disassembled.

Please refer to FIG. 1 to FIG. 5. The embodiments of this application are as follows:

Referring to FIG. 1 to FIG. 3, a water pump with a suspension function includes a pump casing 1, a pump cover 5, a motor 7, a pressing ring 4, a volute 8, a base 12 and a cable. A top of an inner cavity of the pump casing 1 is provided with a motor mounting chamber 108 extending downwards and a closed chamber 109 located around the motor mounting chamber 108. The motor 7 is vertically provided in the motor mounting chamber 108 and extends downwards to a position below the motor mounting chamber 108. By mounting the motor 7 through the motor mounting chamber 108, a certain amount of buoyancy is provided. By using the closed chamber 109, the buoyancy on the water surface is ensured and the suspension stability is improved.

Referring to FIG. 1, the pump casing 1 adopts a biomimetic turtle shell structure, a turtle shell pattern 104 is provided on an outer wall of the pump casing 1, and an edge of the pump casing 1 is provided with a turtle-shell-shaped corrugated skirt 105. The upper part of the pump casing 1 floats on the water surface, thus achieving a good aesthetical effect.

Figure 4:
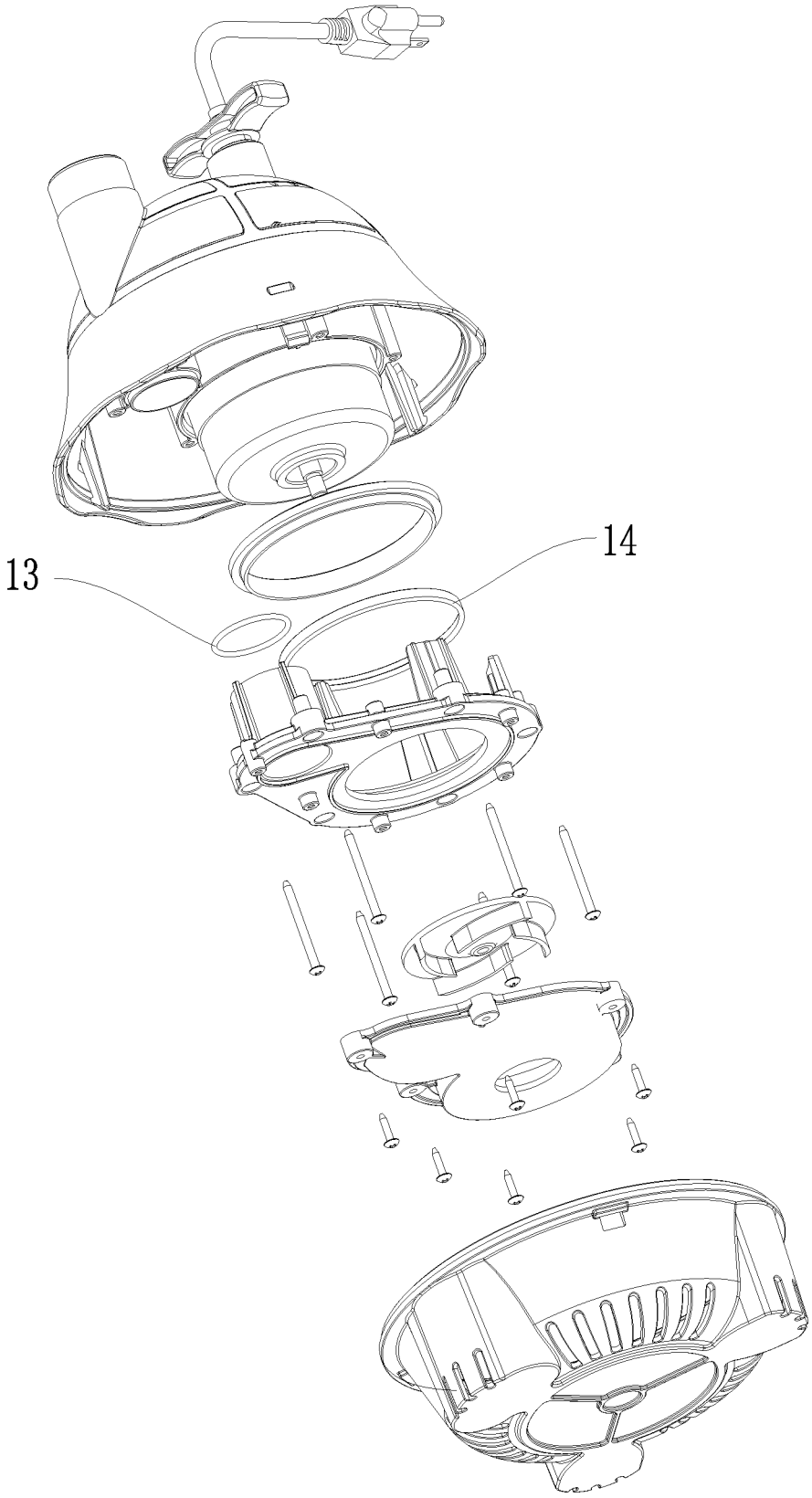
FIG. 4 illustrates an exploded view of FIG. 1.
Figure 5:
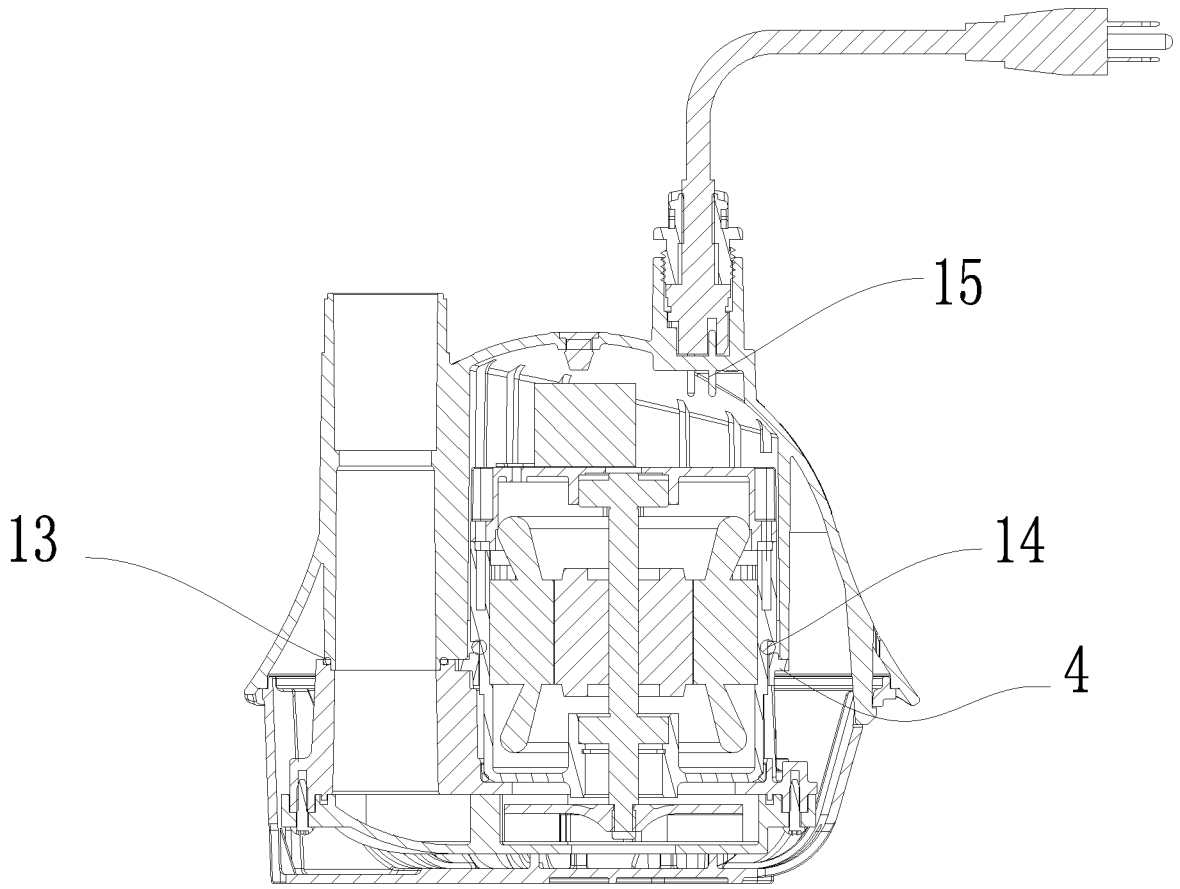
FIG. 5 illustrates a sectional view of a water pump with a suspension function according to an exemplary embodiment of this application.

The pressing ring 4 is provided on a housing of the motor 7 in a sleeving manner and is located at a bottom of the motor mounting chamber 108. A second sealing ring 14 located above the pressing ring 4 is provided between a housing of the motor 7 and an inner wall of the motor mounting chamber 108, as illustrated in FIG. 4 and FIG. 5. The second sealing ring 14 can prevent water below from entering the motor mounting chamber 108, and the bottom of the second sealing ring 14 is limited through the pressing ring 4, thus facilitating the assembling. In addition, in this embodiment, a top of the pump cover 5 is provided with a valve 102 extending into the motor mounting chamber 108, thus facilitating the filling of compressed air into the motor mounting chamber 108, maintaining the high-pressure environment in the motor mounting chamber 108, and further avoiding the problem of water ingress into the motor mounting chamber 108.

A top of the pump casing 1 is integrally provided with a water outlet pipe joint 101 extending downwards. A first connecting port 107 communicated with the water outlet pipe joint 101 and extending downwards is provided in an inner wall of the pump casing 1 to facilitate water output. The pump cover 5 is provided below the first connecting port 107 and the motor 7. In this embodiment, 3-6 supporting columns 501 pointing to the pressing ring 4 are provided on the pump cover 5. The pressing ring 4 is limited through the supporting columns 501 and the bottom end of the motor mounting chamber 108.

Referring to FIG. 3, 5-6 connecting rod screw holders 503 downwards pointing to the pump cover 5 are integrally provided in the pump casing 1. Connecting rod screws 6 connected to the connecting rod screw holders 503 are provided on the pump cover 5. The structure is stable, and the assembling is facilitated. A second connecting port 502 in insertion connection with the first connecting port 107 is provided in the pump cover 5. In this embodiment, a first sealing ring 13 is provided between the first connecting port 107 and the second connecting port 502, thus improving the sealing performance of the connection.

The volute 8 is provided at a bottom of the pump cover 5. Screws 11 connected to the pump cover 5 are provided on the volute 8. The structure is firm. A motor rotating shaft 10 extending downwards into the volute 8 is provided in the motor 7. A bottom of the motor rotating shaft 10 is provided with an impeller 9 located in the volute 8. a bottom of the volute 8 is provided with a water inlet 801 located below the impeller 9. The water enters the volute 8 through the water inlet 801, is sent to the second connecting port 502 through the rotation of the impeller 9, and finally is sent out through the water outlet pipe joint 101.

The base 12 is provided below the volute 8. A surrounding area of the base 12 is in contact with a bottom of the inner wall of the pump casing 1 for closing, thus preventing debris from entering the volute 8 from the surrounding area of the base 12. In this embodiment, a plurality of filter screen holes 1203 are provided in the base 12. The water flows through the filter screen holes 1203 and enters the base 12 for filtration, thus avoiding the problem of underwater impurities entering the volute 8 and protecting the impeller 9.

Referring to FIG. 3, connecting fasteners 106 downwards running through the base 12 are provided in the pump casing 1. Fastener slots 1201 corresponding to the connecting fasteners 106 are provided in the base 12. Referring to FIG. 3, A wedge is provided on one side of each of bottoms of the connecting fasteners 106, so that the connecting fasteners 106 are elastically deformed in the process of being downwards inserted into the fastener slots 1201, are elastically restored after the bottom ends of the connecting fasteners 106 run through the fastener slots 1201, and are self-locked through the wedges. The operation is simple and convenient to perform, and the disassembling is facilitated.

The bottom of the base 12 is provided with 1-5 feet 1202, through which a certain ground clearance is ensured. Even after touching the bottom, it can maintain the stability of the base 12 and reduce the problem of the base 12 being buried by underwater mud.

A cable interface 103 is provided in the pump casing 1. A front end of the cable 3 extends to the cable interface 103 for insertion connection. Referring to FIG. 5, a socket 15 extending downwards into the motor mounting chamber 108 is provided in the cable interface 103. The cable 3 is in insertion connection with a top of the socket 15 and is electrically connected to the motor 7 through a bottom of the socket 15, and the sealing performance is ensured. In addition, a lifting handle 2 in threaded connection with the cable interface 103 is provided on the cable 3 in a sleeving manner, thus facilitating the assembling and the grabbing of the water pump.

To sum up, in the water pump with the suspension function disclosed in this application, the upper part of the pump casing is suspended on the water surface, thus clearly indicating the position of the water pump, achieving a good aesthetic effect, avoiding the problem of the base being buried by underwater mud, preventing underwater impurities from being sucked in, improving work stability, ensuring the sealing performance of the motor mounting chamber 108, and protecting the motor.

The above are only embodiments of this application, which do not limit the scope of protection of this application. Any equivalent structure or equivalent process transformations made according to the content of the description of this application, or direct or indirect applications in other related technical fields, are equally included in the scope of protection of this application.

The invention claimed is:

1. A water pump with a suspension function, comprising: a pump casing (1), a pump cover (5), a motor (7), a pressing ring (4), a volute (8) and a base (12), a top of an inner cavity of the pump casing (1) being provided with a motor mounting chamber (108) extending downwards and a closed-ring shaped chamber (109) located around the motor mounting chamber (108), the motor (7) being vertically provided in the motor mounting chamber (108) and extending downwards to a position below the motor mounting chamber (108), the pressing ring (4) being provided on a housing of the motor (7) in a sleeving manner and being located at a bottom of the motor mounting chamber (108), a top of the pump casing (1) being provided with a water outlet pipe joint (101) extending downwards, a first connecting port (107) communicated with the water outlet pipe joint (101) and extending downwards being provided in an inner wall of the pump casing (1), the pump cover (5) being provided below the first connecting port (107) and the motor (7), a plurality of supporting columns (501) pointing to the pressing ring (4) and being provided on the pump cover (5), a plurality of connecting rod screws (6) downwards pointing to the pump cover (5) being provided in the pump casing (1), connecting rod screw holders (503) connected to the connecting rod screws (6) and being provided on the pump cover (5), a second connecting port (502) in insertion connection with the first connecting port (107) being provided in the pump cover (5), the volute (8) being provided at a bottom of the pump cover (5), screws (11) connected to the pump cover (5) being provided on the volute (8), a motor rotating shaft (10) extending downwards into the volute (8) being provided in the motor (7), a bottom of the motor rotating shaft (10) being provided with an impeller (9) located in the volute (8), the base (12) being provided below the volute (8), a surrounding area of the base (12) being in contact with a bottom of the inner wall of the pump casing (1) for closing, connecting fasteners (106) downwards running through the base (12) being provided in the pump casing (1), a plurality of filter screen holes (1203) being provided in the base (12).

2. The water pump with the suspension function according to claim 1, wherein a first sealing ring (13) is provided between the first connecting port (107) and the second connecting port (502).

3. The water pump with the suspension function according to claim 1, wherein a second sealing ring (14) located above the pressing ring (4) is provided between the housing of the motor (7) and an inner wall of the motor mounting chamber (108).

4. The water pump with the suspension function according to claim 1, wherein a top of the pump cover (5) is provided with a valve (102) extending into the motor mounting chamber (108).

5. The water pump with the suspension function according to claim 1, wherein fastener slots (1201) corresponding to the connecting fasteners (106) are provided in the base (12).

6. The water pump with the suspension function according to claim 1, wherein a bottom of the base (12) is provided with a plurality of feet (1202).

7. The water pump with the suspension function according to claim 1, wherein a bottom of the volute (8) is provided with a water inlet (801) located below the impeller (9).

8. The water pump with the suspension function according to claim 1, wherein the water pump with the suspension function further comprises a cable (3), a cable interface (103) is provided in the pump casing (1), a front end of the cable (3) extends to the cable interface (103) for insertion connection, and a lifting handle (2) in threaded connection with the cable interface (103) is provided on the cable (3) in a sleeving manner.

* * * * *